US005385399A

United States Patent [19]

Weidner

[11] Patent Number: 5,385,399

[45] Date of Patent: Jan. 31, 1995

[54] DOCUMENT STORAGE AND DISPLAY CABINET

[76] Inventor: Merwyn C. Weidner, P.O. Box 98574, Des Moines, Wash. 98198

[21] Appl. No.: 55,569

[22] Filed: May 3, 1993

[51] Int. Cl.[6] ..... A47F 7/00

[52] U.S. Cl. ..... 312/190; 312/323; 312/319.1

[58] Field of Search ..... 312/190, 192, 322, 323, 312/319.1, 330.1, 334.1

[56] References Cited

U.S. PATENT DOCUMENTS

| | | | |
|---|---|---|---|
| 428,406 | 5/1890 | Noll et al. . | |
| 832,426 | 10/1906 | Sell . | |
| 1,161,339 | 11/1915 | Putnam . | |
| 1,205,604 | 11/1916 | Dungan . | |
| 1,274,446 | 8/1918 | Ratigan . | |
| 3,853,364 | 12/1974 | Lundberg | 312/323 X |
| 4,285,555 | 8/1981 | Hedstrom et al. | 312/190 X |
| 4,596,333 | 6/1986 | Gilreath | 312/190 X |
| 4,709,970 | 12/1987 | Savoie | 312/323 X |
| 5,215,364 | 6/1993 | Moore | 312/323 |

*Primary Examiner*—Edward K. Look
*Assistant Examiner*—Hoang Nguyen
*Attorney, Agent, or Firm*—Graybeal Jackson Haley & Johnson

[57] ABSTRACT

Document storage and display cabinet with one or more pull-out and tilt-down drawers with each drawer having a spring-loaded hold-down and line marking rod which spans substantially the full width of the drawer and is positionable in any location from the front to the rear of the drawer and which by interaction with its spring loading is movable to a raised position spaced from the face of the drawer so as to not impede repositioning or movement of a document onto or out of the drawer.

6 Claims, 4 Drawing Sheets

32
34
56
C
60
52
30
58
54
68
48
70
62
66
50
44
38
64
72
20
40
14
24
16
36
20
46
24
D
42

DOCUMENT STORAGE AND DISPLAY CABINET

BACKGROUND OF THE INVENTION

1. Field of the Invention

Document storage and display cabinet with individually withdrawable trays or drawers in stacked arrangement and with document hold-down means spanning and movable by the user across the entire face of the tray or drawer.

2. Description of the Prior Art

Storage cabinets with pull-out trays or drawers which tilt down at an angle to display drawer contents and with document hold-down means have long been well-known, such as disclosed in Noll et al U.S. Pat. No. 428,406, Sell U.S. Pat. No. 832,426, Dungan U.S. Pat. No. 1,205,604, and Ratigan U.S. Pat. No. 1,274,446. However, in such cabinets, the document hold-down means are typically movable in the sense of being liftable and pressed by spring action against documents in a drawer but such hold-down means do not fully span and are not movable across the face of the drawer so as to function as a line marker in relation to and across the full width of a document filling and arranged open-face in the drawer, for example.

Also known are stand type copy or book holders such as disclosed in Putnam U.S. Pat. No. 1,161,339, wherein is disclosed a copy or book holder with a wire strand 11 which is movable vertically on the stand on rods 10, with the wire strand 11 serving to hold a book or paper on the stand in an open position. However, the configuration of the parts is such that the wire strand 11 of the Putnam stand is movable only vertically on the stand a distance less than the full vertical height of the face of the stand and does not span and is not movable horizontally relative to the face of the stand.

SUMMARY OF THE INVENTION

This invention provides in a document storage and display cabinet at least one and preferably a series of individually withdrawable shelves or drawers in stacked arrangement, each of which can be pulled out by the user and tilted down at an angle to display documents in the drawer. Each drawer is equipped with a document hold-down rod which is designed to hold any given book or like document open on the face of the drawer and to serve as a line marker at any desired level across the entire face of the drawer.

It is a further feature and advantage of the storage and display drawer assembly of the present invention that the hold-down means which spans substantially the entire horizontal width of the drawer and is movable throughout the entire height of the drawer is spring-loaded so as to be urged by spring action against the face of the drawer and also arranged in conjunction with its spring means to have a stable, at-rest position with the hold-down rod raised substantially above the face of the drawer so that documents can be replaced or removed or changed in position relative to the face of the drawer without the hold-down rod impeding such movement.

A further object and feature of the present position is to provide in a storage and display cabinet drawer assembly document hold-down and line marker means comprising guide rods arranged substantially parallel to the edges and spanning the height dimension of the face of the drawer, with the document hold-down rods spanning substantially the entire width of the drawer, with two carraige means each movable along substantially the entire length of the associated guide rod, along with trunnion means on each of said carriage means to which a respective end of said hold-down and line marker rod is pivotally journaled with the span of said hold-down end line marker rod across the face of the drawer being parallel to the inner and outer edges of the drawer and laterally offset from the ends of the hold-down rod a distance at least about equal to the length of the said carriage means in the span thereof along the said guide rods, the arrangement also including loop means in the portions of the hold-down and line marker rod connecting the span portion of the hold-down rod with the ends thereof, and respective tension spring means extending between ends of the carriage means and through said loop means, said spring means acting to urge said hold-down rod against the face of the drawer yet permit the hold-down rod to be pivotally moved by the user from and to positions at either side of the carriage means, the rod in its mid position relative to the carriage means being maintained centrally well above the surface of the drawer so as to be out of the way and not impede any desired movement, introduction or withdrawal by the user of a document relative to the face of the drawer.

Further objects, feature and advantages of the invention include provision of a storage and display cabinet with stacked drawers with each drawer comprising nylon rollers movable along adjustable slides placeable at various heights in the cabinet to accommodate various thicknesses of books or other documents arranged in the drawers.

These and other objects, features and advantages of the present invention will be apparent from the following description and accompanying drawings illustrating a preferred, typical embodiment thereof.

DESCRIPTION OF THE PREFERRED EMBODIMENT

Figure 1:
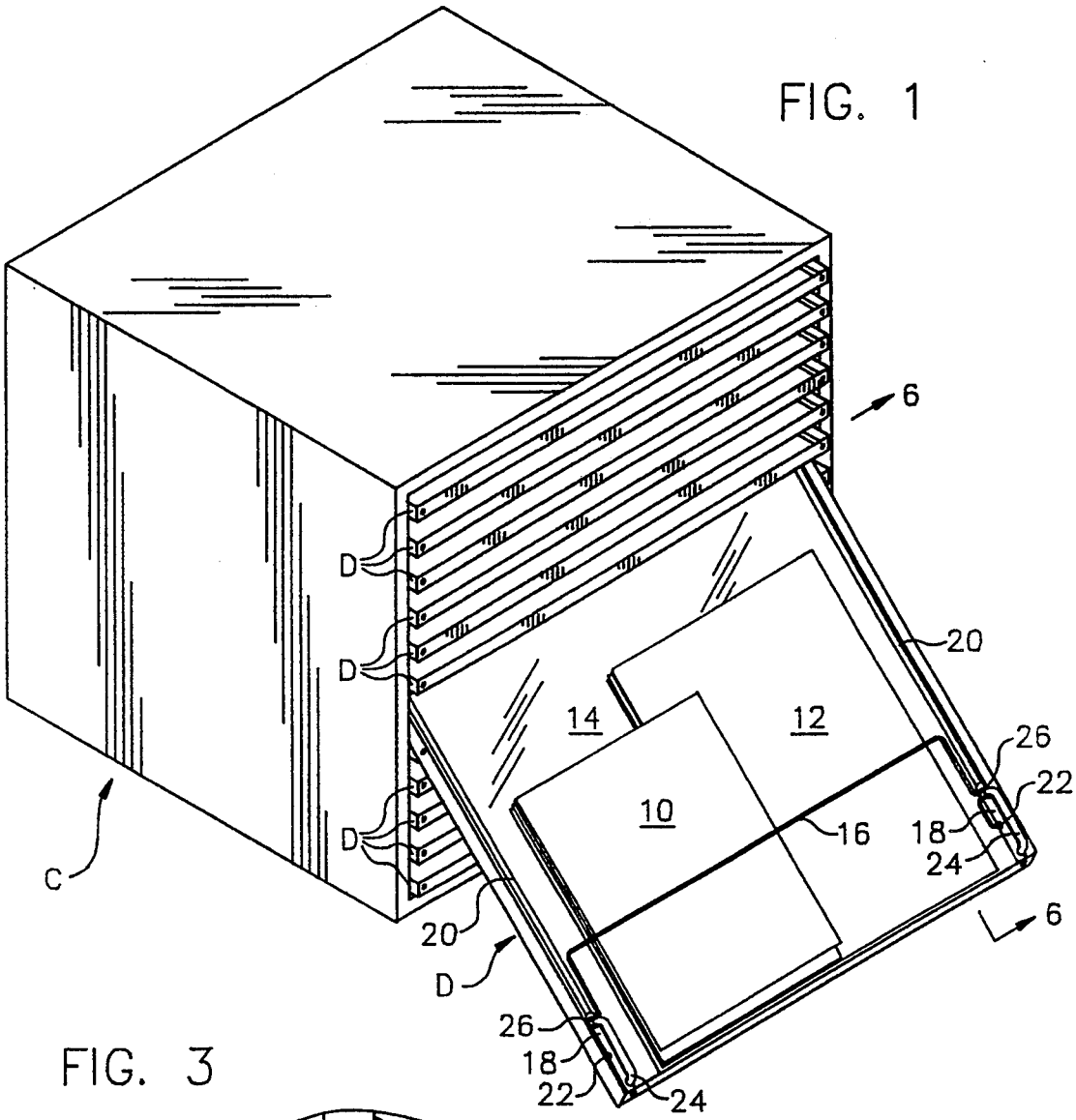
FIG. 1 is an isometric view of a storage and display cabinet according to the present invention, shown with one of its several storage and display drawers pulled out and tilted down.
Figure 4:
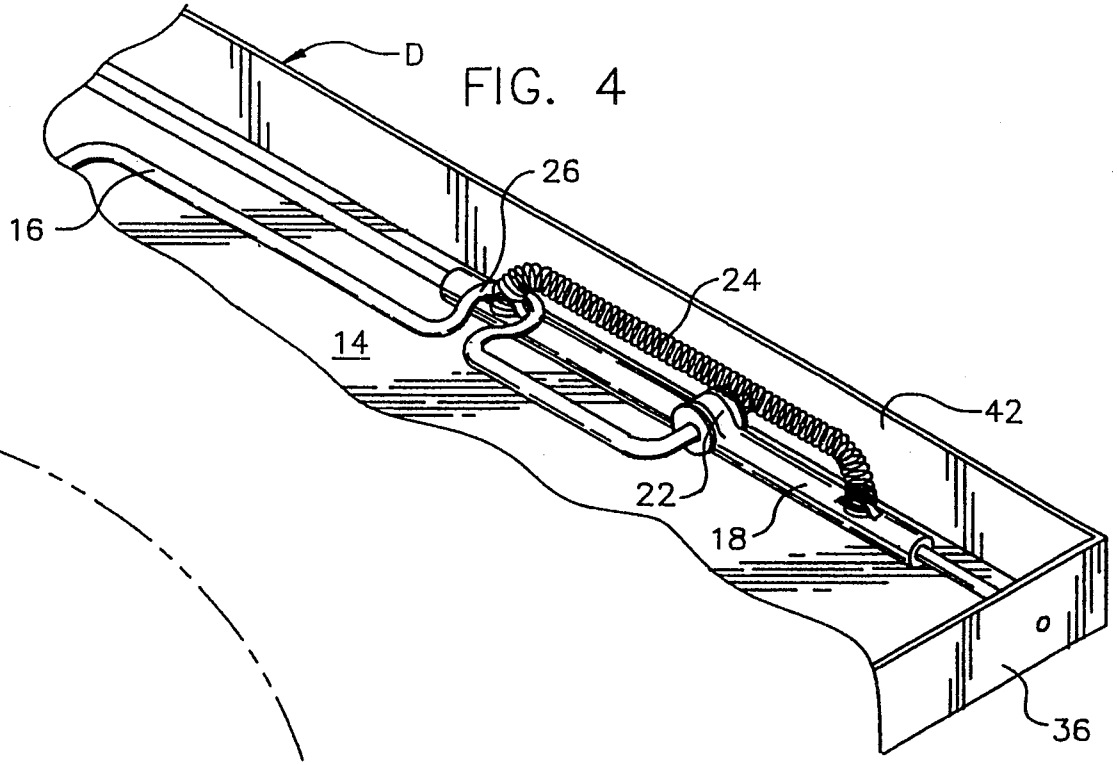
FIG. 4 is an enlarged detail view of part of the right hand edge portion of one of the storage and display drawers of the storage cabinet shown in FIG. 1 showing in further detail the right hand guide rod and associated hold-down rod end and the associated spring and trunnion means.
Figure 5:
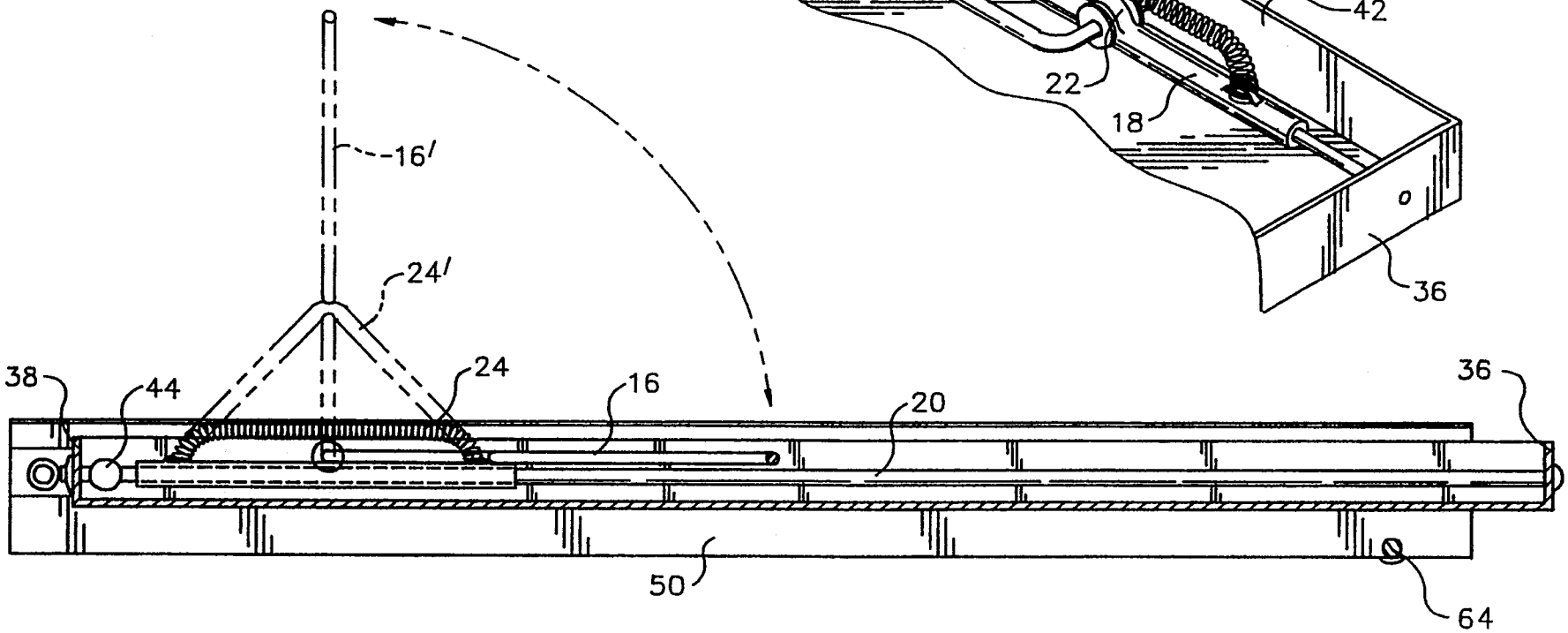
FIG. 5 is a further view in elevation and cross section of the parts shown in FIG. 4.

The storage and display cabinet C shown in FIG. 1 comprises a vertically stacked series of storage and display drawers D, twelve being shown by way of example. As will be understood, each of the drawers D is identical to the others and arranged in the cabinet C to be withdrawn horizontally partly out of the cabinet C and then tilted downwardly to readily display one or more contents such as documents 10, 12 held against the face 14 of the drawer D by hold-down and line marker rod 16. As also shown in FIG. 1 and as is illustrated and discussed in more detail in connection with FIGS. 2–6, the hold-down and line marker rod 16 spans substantially the entire horizontal width of the face 14 of the drawer D and is mounted by mounting means enabling it to be moved to any desired position over substantially the entire height of the drawer D, such mounting means including carriages 18 which are movable to any desired vertical position along respective guide rods 20, with each such carriage means including trunnion means 22 in which each end of the rod 16 is pivotally journaled. Each carriage means 18 near its ends has attached thereto a spring 24 which passes through a loop 26 near the associated end of the rod 16. The springs 24 spring load the rod 16 so that it normally presses against the face 14 of the drawer D or any documents or the like on the face of the drawer D. As best understood in connection with FIGS. 5 and 6, the arrangement of the springs 24 in conjunction with the loop means 26 of the rod 16 is such that the rod 16 when in a relatively raised position remains in spaced relation while above the face 14 of the drawer D, and stably so, so that the rod 16 is out of the way and does not impede any any movement of the documents on the drawer face yet is easily brought into a position in engagement with the face 14 of the drawer D or any document or documents thereon simply by the user urging the rod 16 in the desired direction whereupon the rod 16 snaps down against the face of the drawer D or the document or documents on the drawer face 14, as the case may be. FIG. 5 shows, for example, the rod 16 in drawer or document engaging position in solid line and in raised position away from the drawer face in broken line, as indicated at 16'

Figure 2:
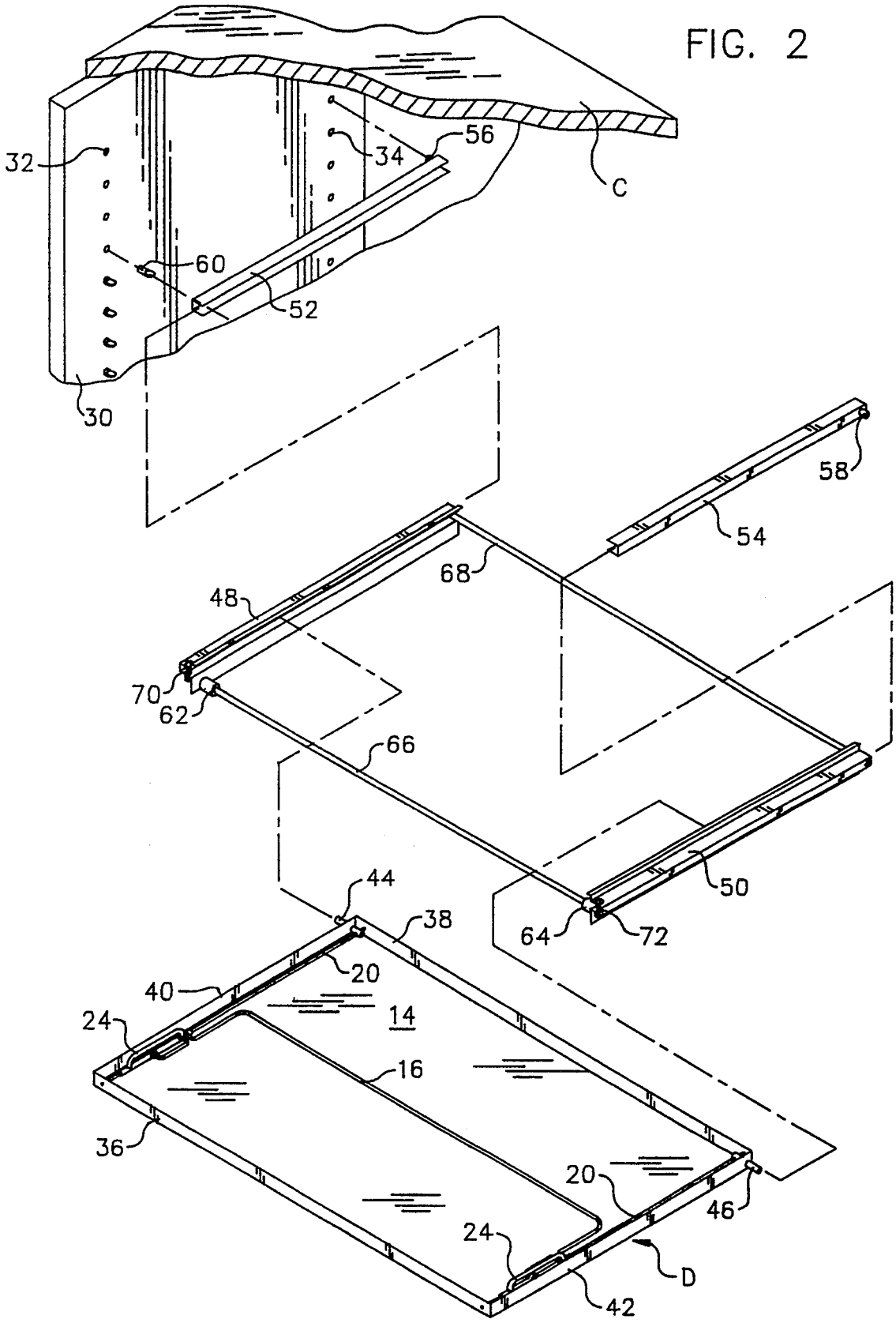
FIG. 2 is an exploded isometric view on a larger scale of a cutaway portion of the cabinet shown in FIG. 1, and of one of the drawer assemblies with its associated support frame.

FIG. 2 is an exploded isometric view illustrating in more detail the arrangement of a withdrawable drawer D in the cabinet C. Interiorly of the side walls of cabinet C, one of which is shown in FIG. 2 at 30, vertical adjustability as to placement of the various drawers D in the cabinet C is provided by a vertical series of holes 32, 34, with a like arrangement of holes, not shown, interiorly of the right wall, not shown, of the cabinet C.

Each assembly of parts for each drawer D is identical to the assembly of parts for each other drawer D and the showing of one drawer assembly at FIG. 2 suffices to describe all. Drawer D as shown in FIG. 2 includes the parts 14 through 28 as discussed in connection with FIG. 1 and further includes respective front, rear, left and right upright walls 36, 38, 40, 42. Rearwardly, left and right walls 40, 42 have mounted therein pins 44, 46 which interiorly retain the rear ends of the guide rods 20 and exteriorly ride in respective left and right rails 48, 50 which are in turn held in frictional engagement with and are nominally relatively stationary within the cabinet C by reason of their engagement with beams 52, 54 located respectively on the interiors of the left and right walls of the cabinet C, each such beam 52, 54 being provided with a rearwardly located, outwardly protruding pin 56, 58 which engages respective rear holes (e.g. 34) in the side walls (e.g. 30) of the cabinet C and which forwardly rest on respective support pins, the left one of which is indicated at 60, placed in a selected hole of the front series of holes (e.g. 32 ).

In its movement in and out of the cabinet C relative to the rails 48, 50, the drawer D is supported by engagement of the bottom of the drawer D with nylon rollers 62, 64 near the ends of a front tie bar 66. Rear tie bar 68 completes, with the front tie bar 66 and the side rails 48, 50, a sturdy support frame for the drawer D when the drawer D is in closed or partially closed position relative to the cabinet C. When the drawer D is pulled out to its tilt down position as shown in FIG. 1, the pins 44, 46 riding in the rails 48, 50 move forwardly to the point of engagement with stop bolts 70, 72.

Figure 3:
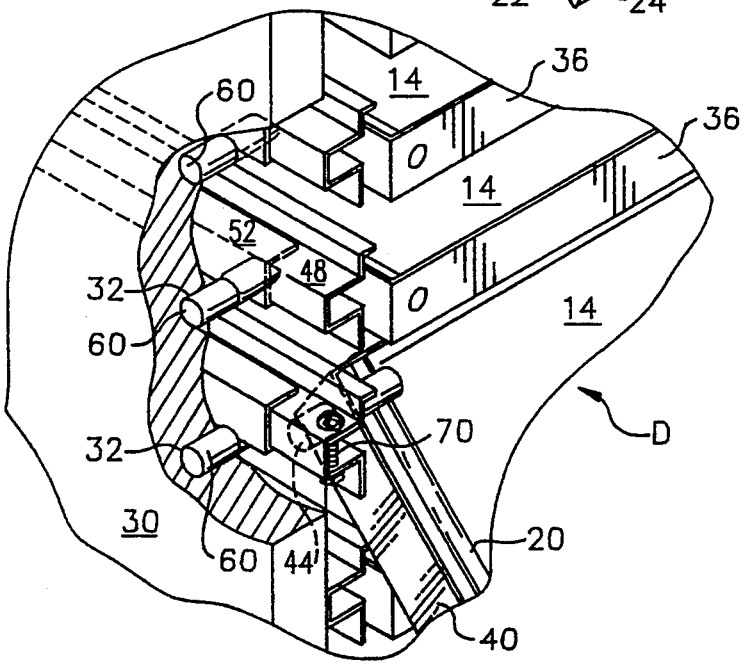
FIG. 3 is a fragmentary isometric view on a further enlarged scale with portions cutaway to further illustrate the assembled relationship of parts of the drawers and supporting components of the storage and display cabinet shown in FIG. 1.

FIG. 3 shows in larger detail the arrangement of parts including the rails 48 and the beams 52, as well as the pin 44 in engagement with the stop bolt 70 for the drawer D which is in tilted down position.

Although rails 48, 50 are nominally stationary in use relative to the side wall mounted beams 52, 54 in the cabinet C, the configuration and the frictional engagement between the rails 48, 50 and the respective beams 52, 54 enable each drawer D and the supporting structure including the rails 48, 50 and tie bars 60, 68 to be withdrawable completely from the cabinet C, which may be desirable to shift the location, vertically considered, of a given drawer D and its supporting frame in the cabinet C. With such withdrawal of a given drawer D and its supporting frame 40, 50, 66, 68, the associated beams 52, 54 can be simply repositoned within the cabinet C at another desired level such as may be appropriate to provide more vertical spacing for a thicker book on a given drawer D, for example.

Concerning the full face adjustability of the hold-down and line marker rod 16, it will be evident that, with the carriages 18 movable on the rods 20 to any position from contact thereof with the front wall 36 of a drawer D to near the rear wall 38 thereof (i.e. to the rear support pin 44 for the rod 20, note FIG. 5), and also noting that the rod 16 is pivotally movable from a position directed rearwardly (as at FIGS. 1 and 4), to a position directed forwardly (as shown in solid line in FIG. 5) it is evident that the rod 16 can be positioned, and will remain in any selected position, vertically considered, on the drawer D, from a position in contact with the inner face of the front wall 36 to a position in contact with the inner face of the rear wall 38 and any position therebetween, with the rod 16 spanning essentially the entire width of the face of the drawer D in any such position.

Figure 6:
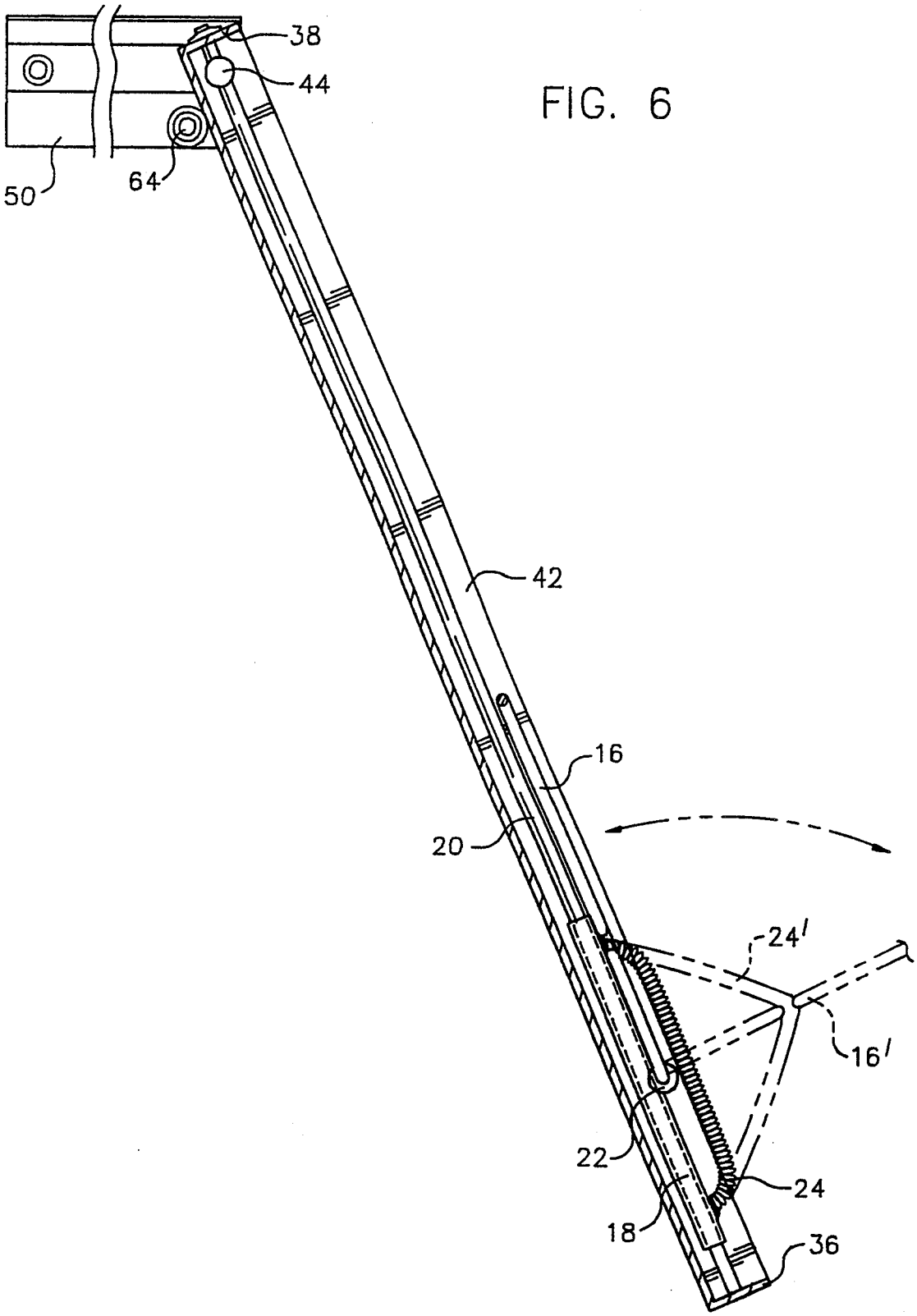
FIG. 6 is a further view in cross section and partially in elevation, similar to the showing of FIG. 5 but with the drawer pulled out to its tilted down, display position, i.e. taken substantially along line 6—6 of FIG. 1.

As will also be apparent, the purpose of the cabinet arrangement with the plurality of pull-out and tilt-down drawers characterizing the invention is in part to alleviate the clutter of having many books left open at one time on a limited desk space or on a working counter space such as in a kitchen. This cabinet arrangement allows easy access to as many books as desired to be left open in both closed and tilted down drawers. Evident as well in this respect is the fact that the cabinet is usable for storage and display of many types of documents including books, maps, folders, spreadsheets and the like. While the cabinet arrangement shown and described as a preferred embodiment which includes several identical pull-out drawers, certain features and advantages of the present invention can be utilized in storage and display arrangement drawers of different sizes, or involving but a single drawer or shelf, in terms of utilization of the full face adjustability and stable hold-down characteristic of the hold-down and line marker rod and its associated components such as shown in FIGS. 4–6.

These and other advantages, features and adaptations of the present invention will be apparent to those skilled in the art to which the invention is addressed within the scope of the following claims.

What is claimed is:

1. In a document display device, including a document display surface having front, rear and side edges, and a document hold-down means movable by the user across the document display surface of the device, the improvement wherein said document hold-down means comprises guide rods extending front to rear of the document display surface substantially at the side edges thereof, carriage means on and movable by the user along said guide rods throughout the span thereof between the front and the rear of the document display surface, a hold-down rod with the ends thereof mounted for pivotal movement with respect to said carriage means and with a central portion laterally offset from said carriage means, said central portion spanning substantially the entire width of said document display surface, spring means acting between said carriage means and said hold-down rod to normally urge the rod toward the document display surface, the coordinated movability of the carriage means on the guide rods and the pivotal movability of the hold-down rod on the carriage means enabling placement by the user of the central portion of the hold-down rod in any position front to rear relative to the document display surface.

2. In a document display device according to claim 1, the improvement wherein said guide rods are arranged parallel to said document display surface and the pivotal movement of the hold-down rod with respect to the carriage means is about trunnion means on said carriage means and about axes parallel to said document display surface.

3. In a document display device according to claim 1, loop means situated near the ends of said hold-down rod against which said spring means acting between said carriage means and said hold-down rod are urged, the said hold-down rod being urged toward said document display surface when the rod is moved to a position closely adjacent said document display surface and said hold-down rod being held in a mid-position by said spring means when centrally positioned on said carriage means.

4. In a document storage and display cabinet, comprising a drawer arranged to be withdrawn horizontally partly out of the cabinet and to then tilt downwardly to readily display a document in the drawer to a user of the cabinet without removal of the document from the drawer, and a document hold-down means movable by the user with respect to the face of the drawer and urged against the face of a document in place in the drawer, the improvement wherein said hold-down means comprises guide rods extending front to rear of the drawer substantially at the side edges of the drawer, carriage means on and movable by the user along said guide rods throughout the span thereof between the front and the rear of the drawer, a hold-down rod with the ends thereof mounted for pivotal movement with respect to said carriage means and with a central portion laterally offset from said carriage means, said central portion spanning substantially the entire width of said drawer, spring means acting between said carriage means and said hold-down rod to normally urge the rod toward the drawer surface, the coordinated movability of the carriage means on the guide rods and the pivotal movability of the hold-down rod on the carriage means enabling placement by the user of the hold-down rod in any position front to rear relative to the drawer surface.

5. In a storage and display cabinet according to claim 4, a plurality of said drawers in vertical array, arranged to be individually withdrawn from and tilted downwardly with respect to said cabinet.

6. In a storage and display cabinet according to claim 4, means by which a plurality of drawers in said cabinet are individually vertically placeable in said cabinet to enable variation in the spacing between a given drawer and an adjacent drawer or the top or bottom of the cabinet, as the case may be, to accommodate placement and storage of documents of various thicknesses in said drawers.

* * * * *